US008170428B2

(12) United States Patent
Bettiol

(10) Patent No.: US 8,170,428 B2
(45) Date of Patent: May 1, 2012

(54) METHOD FOR INTERCHANGING COMPONENTS IN A PRINTING APPARATUS

(75) Inventor: David E. Bettiol, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 480 days.

(21) Appl. No.: 12/330,772

(22) Filed: Dec. 9, 2008

(65) Prior Publication Data

US 2010/0142977 A1 Jun. 10, 2010

(51) Int. Cl.
*G03G 15/08* (2006.01)

(52) U.S. Cl. ..... 399/27; 399/110; 399/111; 399/112; 399/119

(58) Field of Classification Search ..... 399/27, 399/110, 111, 112, 118, 119
See application file for complete search history.

(56) References Cited

U.S. PATENT DOCUMENTS 5,835,817 A 11/1998 Bullock et al.
6,795,660 B2 * 9/2004 Yugeta et al. ..... 399/27
7,010,242 B2 * 3/2006 Suzuki et al. ..... 399/110
2003/0163275 A1 8/2003 Farrell et al.
2005/0151776 A1 * 7/2005 Johnson et al. ..... 347/19
2005/0281591 A1 12/2005 Kitozaki et al.
2006/0120736 A1 * 6/2006 Kakuno et al. ..... 399/27
2007/0153311 A1 7/2007 Carling et al.
2009/0263145 A1 10/2009 Mandel et al.
2009/0285586 A1 11/2009 Kawaguchi

FOREIGN PATENT DOCUMENTS

EP 0 551 631 A2 7/1993
JP 2005-107440 A 4/2005

* cited by examiner

*Primary Examiner* — David Gray
*Assistant Examiner* — G. M. Hyder
(74) *Attorney, Agent, or Firm* — Donna P. Suchy

(57) ABSTRACT

A method may include the steps of providing a printing assembly that includes a plurality of printing modules that each include a specific toner color, wherein a first printing module is failing and at least one second printing module is functioning; determining a toner use demand for the plurality of printing modules; and swapping the first printing module with the at least one second printing module to facilitate reducing a downtime of the printing apparatus, wherein the first printing module has a toner use demand that is substantially greater than the toner use demand of the at least one second printing module.

9 Claims, 4 Drawing Sheets

METHOD FOR INTERCHANGING COMPONENTS IN A PRINTING APPARATUS

FIELD OF THE INVENTION

This invention relates in general to electrographic printing, and more particularly to reducing downtime of a multi-toner printing apparatus.

BACKGROUND OF THE INVENTION

One method for printing images on a receiver member is referred to as electrophotography. In one example, an electrophotographic printing device may create multi-color toner images using a plurality of color imaging printing modules coupled within the printing device. The printing modules may be arranged in tandem such that the toner images are successively electrostatically transferred to the receiver member.

Known examples of printing devices may deposit toner at specific locations on the receiver member and/or on top of other previously deposited toner using the plurality of printing modules. Once the receiver member has received the appropriate toner images the final print image may be permanently fixed to the receiver member typically using heat, and/or pressure. Multiple layers or marking materials can be overlaid on one receiver, for example, layers of different color particles can be overlaid on one receiver member to form a multi-color print image on the receiver member after fixing.

In the event one of the printing modules experiences a failure, the performance of the printing device and/or the quality of the final printed image may be decreased. Generally, there are at least two types of printing module failures that may occur: (1) hard failures and (2) soft failures. During a hard failure, for example, at least one of the components of the printing module may become non-functional. As a result, during a hard failure, the affected printing module may be non-functional. In a soft failure, however, the failing printing module may still function albeit at a lower performance level or the printing module may print toner images that may contain artifacts therein.

Print providers have been looking for ways to reduce the downtime of a printing device that experiences failures.

SUMMARY OF THE INVENTION

In one exemplary embodiment, a method for interchanging components between a failing printing module and a functioning printing module may be provided. The method may include the steps of providing a printing assembly that includes a plurality of printing modules that each include a specific toner color, wherein a first printing module is failing and at least one second printing module is functioning; determining a toner use demand for the plurality of printing modules; and swapping the first printing module with the at least one second printing module to facilitate reducing a downtime of the printing apparatus, wherein the first printing module has a toner use demand that is substantially greater than the toner use demand of the at least one second printing module.

In another exemplary embodiment, a method of preventing downtime of a printer assembly may be provided. The method may include providing a printer assembly that includes a plurality of printing modules that each include a first toner color coupled therein; determining a toner use demand for each toner color of each printing module, wherein a primary printing module has the greatest toner use demand; and adding a redundant printing module that includes a redundant toner color that is substantially identical to the first toner color of the primary printing module.

In yet another exemplary embodiment, a means of decreasing a downtime of a printing apparatus may be provided. The means may include means for determining a failure of one of a plurality of printing modules; means for determining a toner use demand of each of the plurality of printing modules; and means for swapping the failing printing module with a functioning printing module, wherein the failing printing module has a toner use demand that is substantially greater than the toner use demand of the functioning printing module.

The invention, and its objects and advantages, will become more apparent in the detailed description of the exemplary embodiments described herein.

BRIEF DESCRIPTION OF THE DRAWINGS

In the detailed description of the preferred embodiments of the invention presented below, reference is made to the accompanying drawings, in; which.

DETAILED DESCRIPTION OF THE INVENTION

Referring now to the accompanying drawings, FIGS. 1-4 show portions of an electrographic print engine or printer apparatus suitable for printing multi-color toner images. In one embodiment, as shown in FIGS. 1*a* and 1*b*, the printing apparatus may have four single-color image printing stations or modules arranged in tandem. In another embodiment, as shown in FIGS. 2*a* and 2*b*, the printing apparatus may have five image printing modules arranged in tandem. The invention contemplates that a plurality of printing modules may be combined to deposit toner on a single receiver member to produce multi-colored images. FIGS. 1*a* and 1*b* are side elevation views of an electrographic printing apparatus 100. In such an embodiment, printing apparatus 100 may include four printing modules, generally indicated as M1, M2, M3 and M4. Printing modules M1-M4 may be arranged in tandem and coupled within printing apparatus 100. Each of printing modules M1-M4 may generate a single-color toner image and may facilitate transferring that image to a receiver member 110 that may be successively moved through printing modules M1-M4. It should be understood that printing apparatus 100 is not limited to this tandem orientation or any other orientation. In the exemplary embodiment, printing module M1 may form black (K) toner color separation images, printing module M2 may form yellow (Y) toner color separation images, printing module M3 may form magenta (M) toner color separation images, and printing module M4 may form cyan (C) toner color separation images.

Figure 2A:
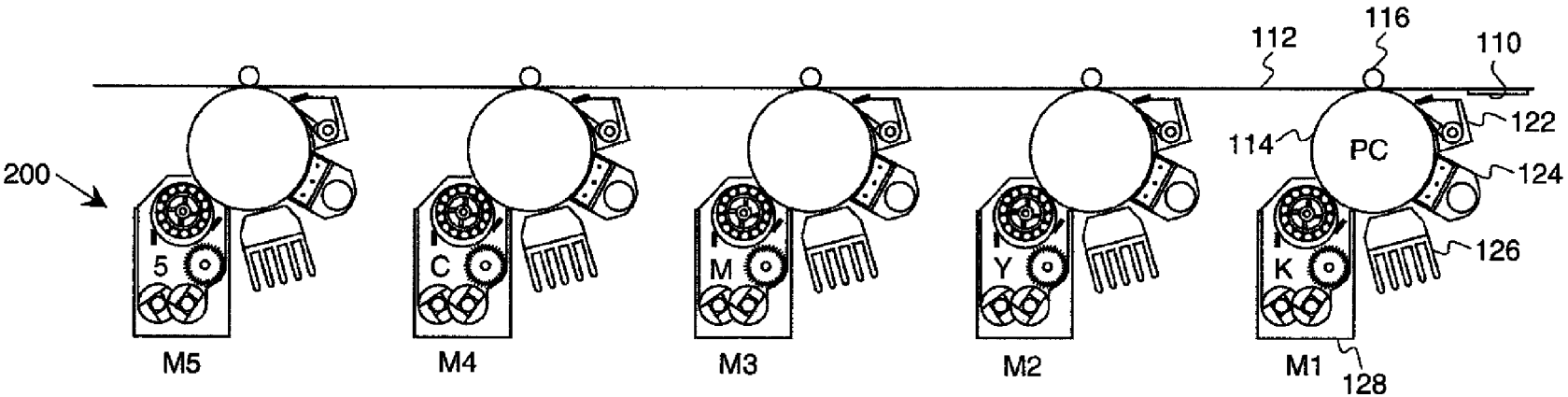
FIG. 2*a* is a schematic cross-sectional side view of another embodiment of an electrographic reproduction apparatus.
Figure 2B:
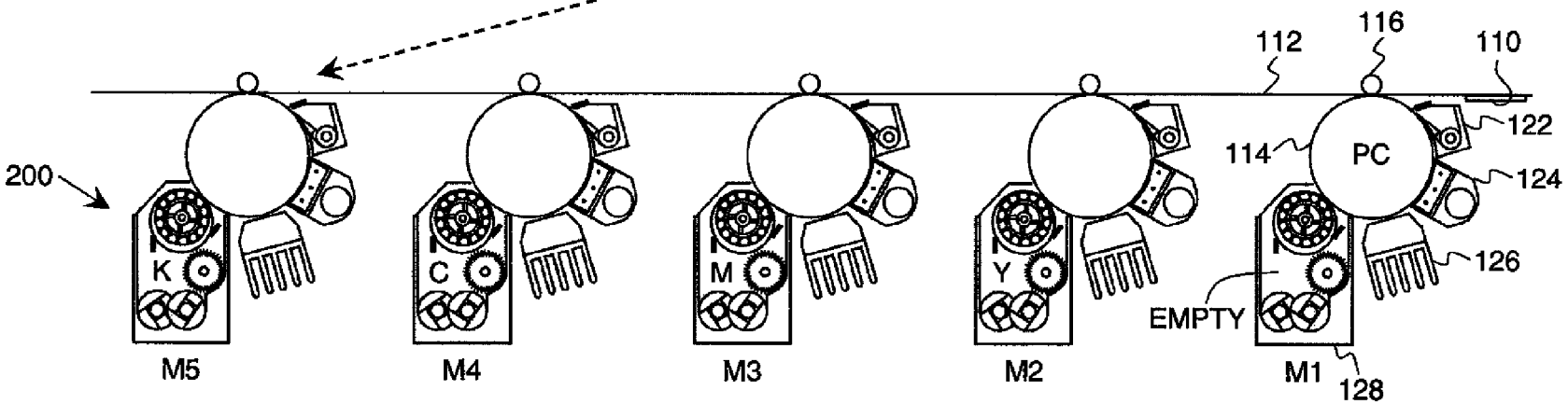
FIG. 2*b* is a schematic cross-sectional side view of the electrographic reproduction apparatus shown in FIG. 2*a;*

In one embodiment, printing modules M1-M4 may be rotatably coupled to a transport device, such as endless belt web 112. A plurality of receiver members 110 may be coupled to belt web 112, wherein each receiver member 110 may receive the print image. Receiver members 110 may be removably electrostatically coupled to belt web 112 via corona tack-down chargers (not shown) or by mechanical devices such as grippers (not shown). FIGS. 2*a* and 2*b* are side elevation views of an alternative printing apparatus 200. Components of printing apparatus 200 are substantially similar to components of printing apparatus 100 and therefore like components are identified with like reference numerals. Printing apparatus 200 may include printing modules M1, M2, M3 and M4. Moreover, printing apparatus 200 may also include a fifth printing module M5 that may include any fifth color, a clear toner or any of the four colors black (K), yellow (Y), magenta (M) or cyan (C) that may be contained within printing modules M1-M4 as described above. In one embodiment, printing modules M1-M5 may be arranged in tandem and coupled within printing apparatus 200. In another embodiment, printing modules M1-M5 may be arranged in any other orientation.

Similarly, as described above, in one embodiment, printing modules M1-M5 may be rotatably coupled to belt web 112. The plurality of receiver members 110 may be coupled to belt web 112, wherein each receiver member 110 may receive the print image. Receiver members 110 may be removably electrostatically coupled to belt web 112 via the corona tack-down chargers or the grippers.

Figure 3:
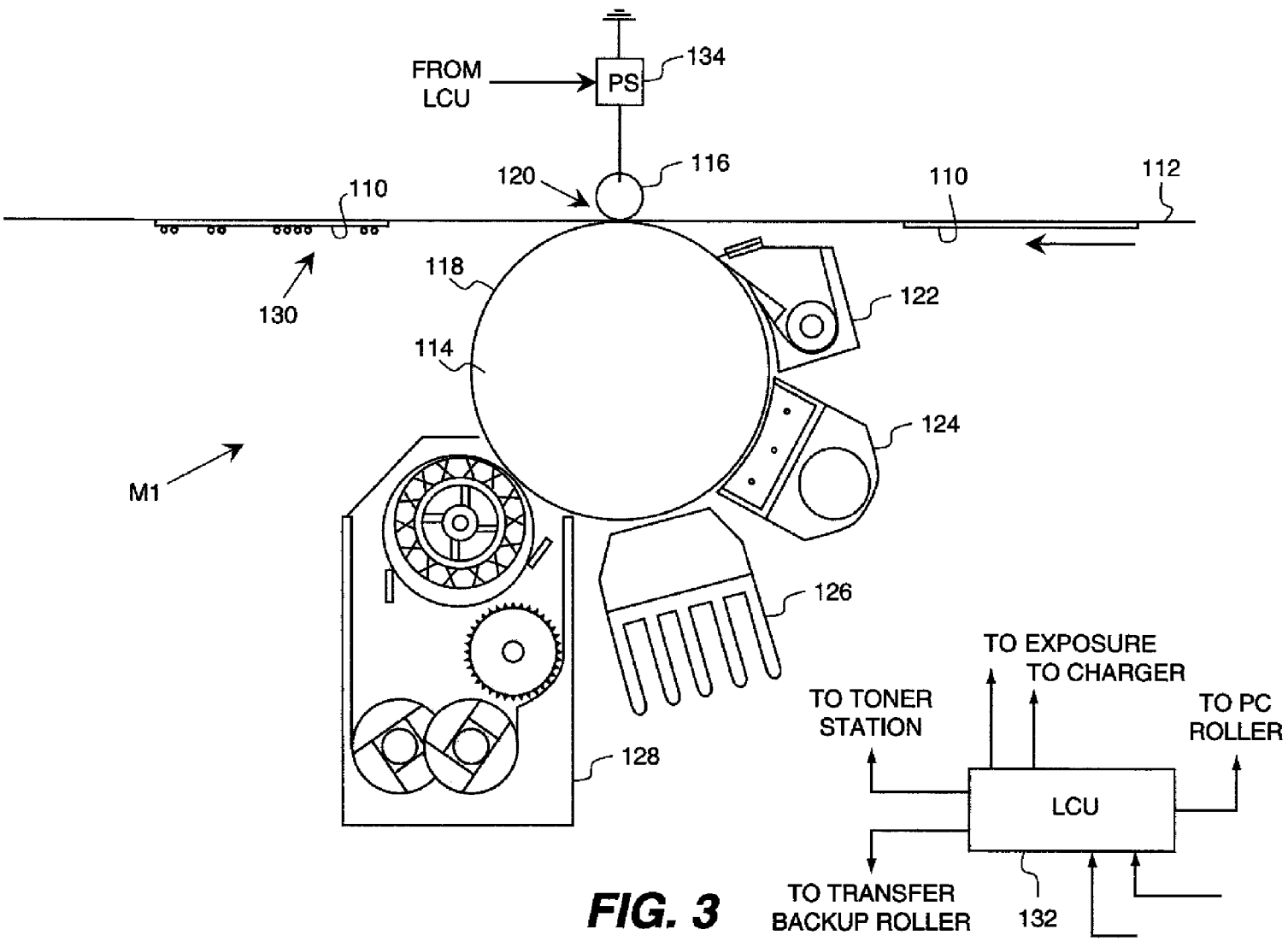
FIG. 3 is an enlarged schematic cross-sectional side view of one printing module.

FIG. 3 is an enlarged side view of printing module M1. It should be understood that each of the printing modules M1-M5 are substantially identical. As a result, the following description of printing module M1 may apply to printing modules M2-M5. In the exemplary embodiment, printing module M1 may include a photoconductive imaging roller 114 and a transfer backup roller 116. Photoconductive imaging roller 114 may have a surface 118 that may be rotatably coupled to belt web 112. Transfer backup roller 116 may also be rotatably coupled to belt web 112 such that transfer backup roller 116 may be positioned substantially adjacent to photoconductive imaging roller 114 such that a transfer nip 120 may be defined therebetween.

Printing module M1 may also include a plurality of electrographic imaging subsystems for producing one or more multilayered images or patterns. For example, in one embodiment, printing module M1 may include a cleaner system 122 that may be operatively coupled to surface 118. Printing module M1 may also include a primary charging system 124 that is operatively coupled to surface 118 of photoconductive imaging roller 114, wherein primary charging system 124 may facilitate uniformly electrostatically charging surface 118. Moreover, printing module M1 may include an exposure subsystem 126 that may be operatively coupled to surface 118, wherein exposure subsystem 126 may facilitate image-wise modulating the uniform electrostatic charge by exposing photoconductive imaging roller 114 to form a latent electrostatic multi-layer (separation) image of the respective layers. Printing module M1 may also include a dry ink, or toner, station 128 that may be operatively coupled to surface 118, wherein toner station 128 may facilitate depositing a color toner image 130 on surface 118 of photoconductive imaging roller 114.

A logic and control unit (LCU) 132 may be provided and may include a microprocessor incorporating suitable look-up tables and control software, which may be executable by LCU 132. The control software may be stored in a memory associated with LCU 132. The control software may include image processing algorithms that facilitate sending the correct image data, or plane, to the appropriate printing module. Moreover, each printing module M1-M5 may have unique calibrations that are color specific and/or module specific. In one embodiment, LCU 132 may facilitate reassigning the unique calibrations to another printing module, as described in more detail below. In another embodiment, LCU 132 may facilitate repeating, or copying, the unique calibrations for a specific color to a different printing module, as described in more detail below. Each toner station 128 may include a toner color identifier (not shown) that may be detected by a plurality of sensors (not shown) coupled within printing modules M1-M5. In a non-limiting example, LCU 132 may automatically reprogram printing module M1 in response to the sensors in the event toner station 128 is swapped out of one of the other printing modules M2-M5 and coupled within printing module M1. Furthermore, LCU 132 may generally nominalize and/or optimize the operating parameters and reduce errors which are attributable to the printing process.

A power supply unit 134 may provide individual transfer currents to the transfer backup rollers 116. LCU 132 may provide control of the various components and process control parameters of the apparatus in response to signals from various sensors (not shown) associated with the electrophotographic printer apparatus. LCU 132 may also provide timing and control signals to the respective components to provide control of the printing apparatus in accordance with well understood and known employments.

During operation, receiver members 110 may be channeled from a paper supply unit (not shown) and transported through the printing modules M1-M5 in a direction as indicated in FIG. 3. Receiver members 110 may be coupled to belt web 112 electrostatically coupled via the corona tack-down chargers. As a result, receiver member 110 may be channeled from the supply source towards transfer nip 120 of printing module M1. In the exemplary embodiment, a colored toner image may be created on surface 118 by exposure subsystem 126, charging system 124 and toner station 128. Photoconductive imaging roller 114 may transfer the respective toner layer (separation) image to receiver member 110. As a result, an unfused toner image 130 may be formed on receiver member 110 shown in FIG. 3 as exiting transfer nip 120. Receiver member 110 may then be channeled towards printing modules M2-M5 wherein receiver member 110 may receive additional toner images coupled thereon. Finally, receiver member 110 may be channeled to a finishing assembly (not shown) that facilitates fusing toner image 130 to receiver member 110.

In the exemplary embodiment, printing module M1 may deposit black (K) toner color separation images; printing module M2 may deposit yellow (Y) toner color separation images; printing module M3 may deposit magenta (M) toner color separation images; and printing module M4 may deposit cyan (C) toner color separation images. An optional printing module M5, as shown in printing assembly 200 in FIGS. 2*a* and 2*b*, may form colors such as red, blue, green or any other color separation image, a clear toner, a gloss finish or type of film.

Figure 4:
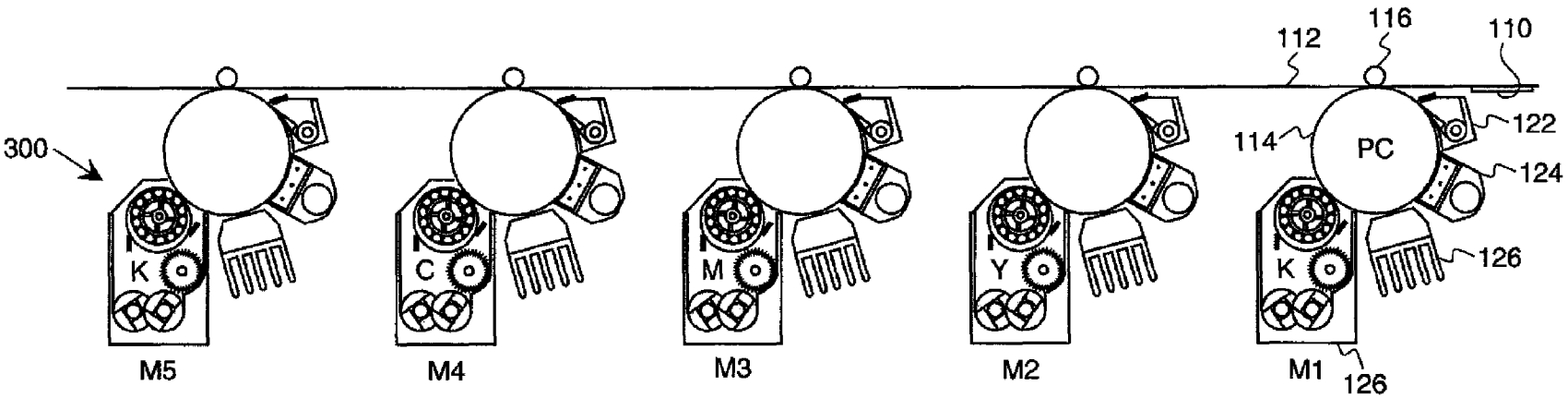
FIG. 4 is a schematic cross-sectional side view of another embodiment of an electrographic reproduction apparatus.

In one embodiment, as shown in FIG. 4, a fifth printing module M5 may be included in printing apparatus 300 and may form one of the colors K, Y, M and C that may be coupled within printing modules M1-M4, respectively. Specifically, FIG. 4 is a side view of an alternative printing apparatus 300. Components of printing apparatus 300 are substantially similar to components of printing apparatus 200 and therefore like components are identified with like reference numerals. In a non-limiting example, printing module M5 may include the K-colored toner, which in this non-limiting example may have a high demand of use. As a result, the K-colored toner printing module M1 may be used more often than printing modules M2-M4 and therefore printing module M1 may have a higher probability of failing due to overuse. To reduce the chance of a failure impacting the performance of printing apparatus 300 and/or the quality of the final printed image, a user may provide printing module M5 that contains a redundant toner color of one of the K, Y, M and C toner colors contained within printing modules M1-M4. Since the K-colored toner is the most frequently used toner color in this non-limiting example, fifth printing module M5 may include K-colored toner coupled therein, for redundancy. In such an embodiment, LCU 132 may be programmed to enable printing modules M1 and M5 to split the demand for K-colored toner. For example, LCU 132 may distribute 50% of the K-color toner demand to printing module M1 and the remaining 50% to printing module M5. As a result, the probability that the K-colored toner will experience a failure is substantially reduced with the addition of printing module M5, as described in more detail below. Alternatively, LCU 132 may assign any percentage of the duties to printing module M1 and any remaining percentage of the duties to printing module M5.

Turning back to printing assemblies 100 and 200, in the event one of the printing modules experiences a failure, the uptime and/or performance of the printing apparatus may be substantially reduced. In the event a printing module experiences a soft failure, a customer and/or field engineer may reconfigure the printing apparatus to enable the printing module to continue performing. Such reconfiguration may facilitate reducing downtime of the printing assembly, as described in more detail below. One such solution to prevent downtime, for example, is to swap the failing component of the affected printing module with a substantially similar component of a functional printing module coupled within the printing apparatus. In another embodiment, the entire printing module may be failing. In such an event, the entire failing printing module may be swapped out with a function printing module that may also be contained within the printing apparatus.

Figure 1A:
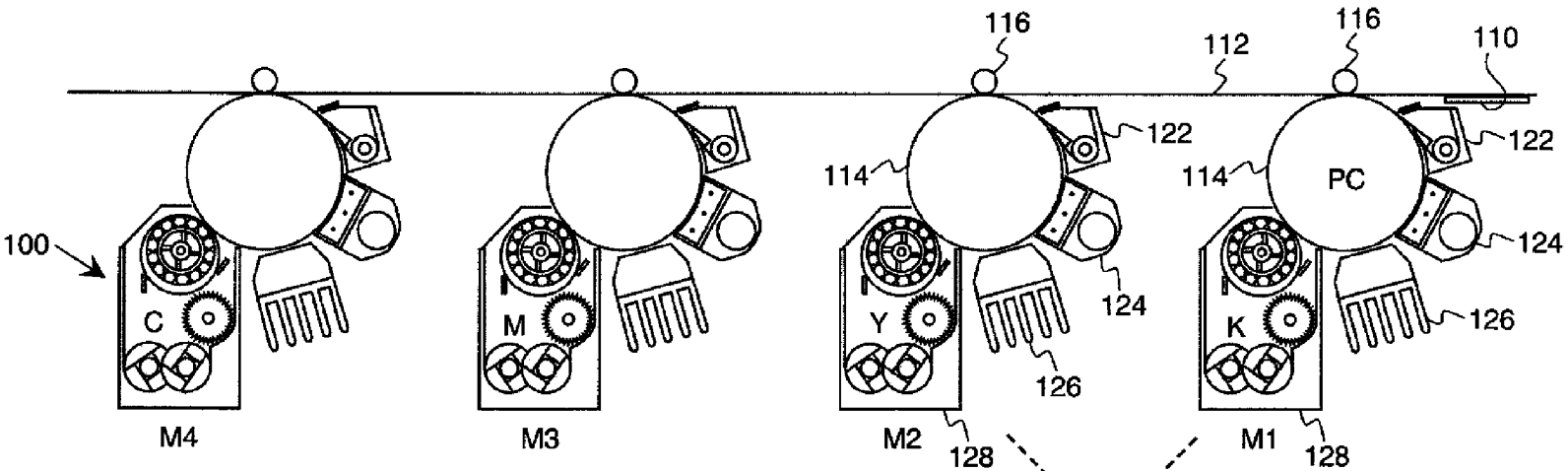
FIG. 1*a* is a schematic cross-sectional side view of an electrographic reproduction apparatus suitable for use with this invention.
Figure 1B:
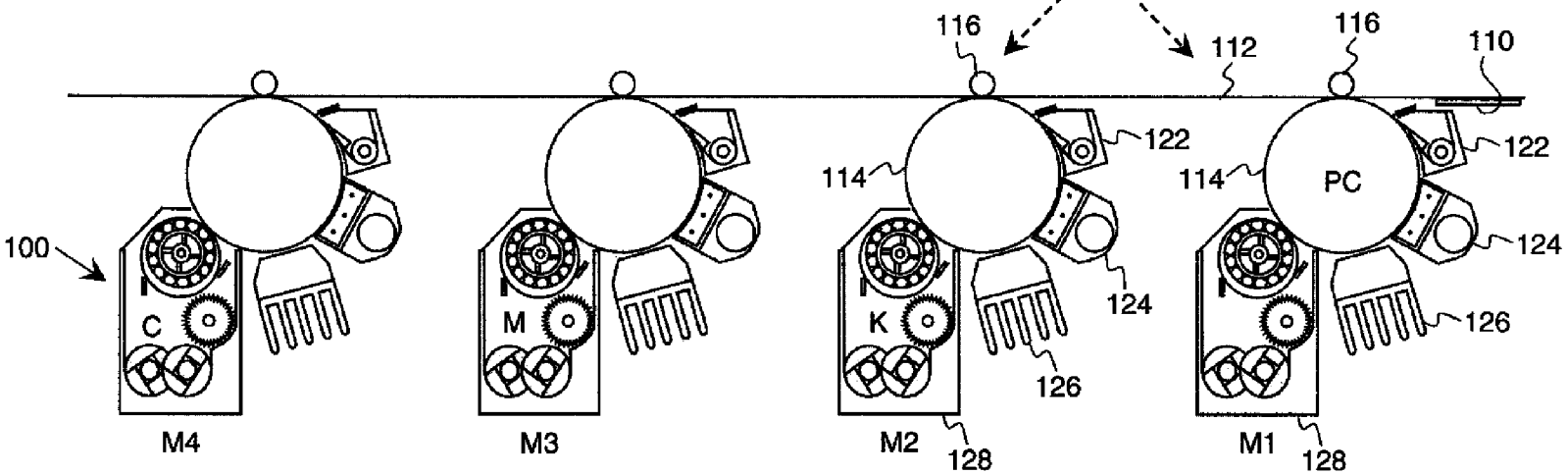
FIG. 1*b* is a schematic cross-sectional side view of the electrographic reproduction apparatus shown in FIG. 1*a;*

Regarding printing apparatus 100, in the event one of printing modules M1-M4, as shown in FIGS. 1*a* and 1*b*, experiences a soft failure, a user, customer and/or technician may reconfigure printing apparatus 100 to enable the affected toner color to continue performing. In this non-limiting example and for the purposes of describing this process, printing module M2 may be the failing module. It should be understood by a person having ordinary skill in the art that any one of printing modules M1-M4 may experience a hard or soft failure.

In the exemplary embodiment, the user may first determine which printing module is experiencing the soft failure. In this non-limiting example, printing module M2 may be experiencing the soft failure. More specifically, the user may determine what toner color is associated with printing module M2. Once the failing toner color is determined, the user may then determine what the respective demands of toner use are for the other functioning color toner printing modules M1, M3 and M4 based on the final printed image printing apparatus 100 may be printing. For example, in the event printing apparatus 100 is printing a green book cover, printing module M4, which has C-colored toner, and printing module M2, which has Y-colored toner, will be substantially used to create the final green printed image for the green book cover. As a result, in this non-limiting example, a toner use demand for C-colored toner and Y-colored toner will be substantially higher than the K-colored toner and the M-colored toner. In such an example, if the Y-colored toner printing module, printing module M2, experiences a soft failure the performance of printing apparatus 100 may decrease. In another embodiment, printing module M2 may include other soft failures such as, but not limited to, printing artifacts in the Y-colored toner image. In such an embodiment, the quality of the final green book cover image will be substantially decreased.

After the user has determined the respective toner use demands for each toner color printing module, the user may determine which component or which components of printing module M2 may be causing the soft failure. For example, one of printing module M2 components, such as, transfer backup roller 116, photoconductive imaging roller 114, cleaner station 122, charging system 124, exposure subsystem 126 and toner station 128 may be the source of the soft failure. In another example, the entire printing module M2 may need to be swapped with a functioning printing module. In a non-limiting example, exposure subsystem 126 may be the source of the soft failure. In such an example, the user may remove exposure subsystem 126 from printing module M2 and replace it with a functioning exposure subsystem 126 from either printing module M1 or printing module M3. In the exemplary non-limiting example, exposure subsystem 126 from printing module M2 may be swapped with the functioning exposure subsystem 126 of printing module M1, as shown by the dotted lines in FIGS. 1*a* and 1*b*. As a result, the failing exposure subsystem 126 can be inserted within printing module M1. As such, the exposure subsystem 126 that is experiencing the soft failure may be moved to a color toner printing module that has a substantially less demand of use in producing the final printed image.

In this non-limiting example, once the failing component (exposure subsystem 126) has been removed from printing module M2 and swapped with the functional exposure subsystem 126 of printing module M1, the effect of the failing component on the performance or quality of the final printed image may be substantially reduced. For example, the lower performance of a printing module that includes a toner color in low demand may not affect the overall performance of printing assembly 100 in printing the final print image. Moreover, a printing module that may print an artifact using a toner color that is in low demand may not be apparent in the final print image. As a result, the quality of the final print image may not be decreased. Therefore, the uptime of printing assembly 100 during a soft failure may be substantially increased.

In the non-limiting example, once the failing component or failing components of printing module M2 have been swapped with functioning components from printing module M1, the unique component calibrations and/or color specific calibrations may be reassigned in LCU 132 from the previous printing module M2 to printing module M1. For example, the functional exposure subsystem 126 may have unique component calibrations that need to be reassigned from the previous printing module M1 to printing module M2. In one embodiment, the unique component calibrations may be pre-programmed calibrations that are uniquely customized for the specific component. In another embodiment, each printing module M1-M4 may have toner color specific calibrations that are pre-programmed for that specific toner color. Therefore, in the event that the entire printing module is swapped or the toner stations are swapped, the toner color specific calibration must also be reassigned in LCU 132 to the appropriate printing module.

Turning to FIGS. 2*a* and 2*b*, in the event one of printing modules M1-M5 of printing apparatus 200 experiences a soft failure, the user may reconfigure printing apparatus 200 to enable the affected printing module to continue performing. In this non-limiting example and for the purposes of describing this process, printing module M2 may also be the failing module. It should be understood by a person having ordinary skill in the art that any one of printing modules M1-M5 may experience a soft failure.

In the exemplary embodiment, the user may first determine which printing module is experiencing the soft failure. In this non-limiting example, printing module M2 may be experiencing the soft failure. Moreover, printing module M5 may include a clear toner. Next, the user may determine what the respective demands of use are for the other functioning color toner printing modules M1-M5 based on the final printed image printing apparatus 200 may be printing.

For example, in the event printing apparatus 200 is also printing a green book cover, printing module M4, which has C-colored toner, and printing module M2, which has Y-colored toner, will be used to create the final green printed image for the green book cover. As a result, in this non-limiting example, a demand of use for C-colored toner and Y-colored toner will be substantially higher than the K-colored toner, M-colored toner and the clear-colored toner of printing module M5. In such an example, if the Y-colored toner printing module M2 experiences a soft failure, the performance of printing module M2 may decrease. In another embodiment, printing module M2 may include other soft failures such as, but not limited to, printing artifacts in the Y-colored toner image. In such an embodiment, the quality of the final green book cover image will be substantially decreased.

There are other ways to determine demand. There are qualitative methods that can be as simple as a subjective judgment by the operator and also quantitative methods that can be precisely calculated by a controller looking at the image content data of the image files in the job queue that is to be printed. This could involve pixel counting to determine toner demand data. One such method is described in U.S. application Ser. No. 11/321,246 entitled PRINT JOB COST ESTIMATE METHOD AND SYSTEM 91589 having a priority date of 29 Dec. 2005.

There are also other ways to determine a probability of failure. There are existing diagnostics (NexPert is an example) available to get the operator/FE down to the root cause component of failure. Alternatively printer historic performance data can be stored and a diagnostic data source created and/or stored in memory. The idea is to identify one or more components and to use the above described methods to create an alternative option to re-locate/reposition the component so it does not need to be replaced at that time and the system can continue to operate.

After the user has determined the respective demands of use for each toner color printing module, the user may determine which component or which components of printing module M2 may be causing the soft failure. For example, one of the components of printing module M2, such as transfer backup roller 116, photoconductive imaging roller 114, cleaner station 122, charging system 124, exposure subsystem 126 and toner station 128 may be the source of the soft failure. In another example, the entire printing module M2 may need to be swapped with a functioning printing module. In this non-limiting example, printing module M5 has a low demand for clear toner in printing the green image book cover. As a result, the user may swap printing module M2 with printing module M5, swap the failing components of printing module M5 with the functioning components of printing module M5 or remove the Y-color toner station 128 and insert the Y-colored toner station 128 into printing module M5. As a result, the effect of the failing component on the performance of printing apparatus 200 or the effect on the quality of the final printed image may be substantially reduced. As such the uptime of printing apparatus 200 during a soft failure may be substantially increased.

Similarly, as described above, once the failing component or components have been swapped with functioning components, the unique calibrations and/or color specific calibrations may be reassigned to the appropriate printing modules in the LCU 132.

Turning to FIG. 4, printing apparatus 300, and more specifically LCU 132, may be configured to enable duty-sharing between redundant toner color printing modules. In a non-limiting example, the K-colored toner print module M1 may be the most frequently used toner color. A user may add an additional K-colored toner to printing module M5 to facilitate reducing the probability of a failure in printing module M1. Moreover, LCU 132 may be programmed to enable printing modules M1 and M5 to share the duties of the K-colored toner demand. In one embodiment, printing modules may split the duties evenly such that printing modules M1 and M5 each perform 50% of the demand for the K-colored toner. Alternatively, the user may divide the duties between the redundant printing modules in any percentage amount.

In the event one of the redundant printing modules M1 or M5 experiences a failure, the user may program LCU 132 to enable 100% of the K-colored toner demand to be reassigned to the functioning printing module. As a result, the downtime of printing apparatus 300 during a failure is substantially reduced.

The invention has been described in detail with particular reference to certain preferred embodiments thereof, but it will be understood that variations and modifications can be effected within the spirit and scope of the invention.

PARTS LIST

Printing apparatus 100
Receiver member 110
Belt web 112
Photoconductive imaging roller 114
Transfer backup roller 116
Surface 118
Cleaner system 122
Charging system 124
Exposure subsystem 126
Toner station 128
Color toner image 130
Logic control unit 132
Power supply unit 134
Printing apparatus 200
Printing apparatus 300

What is claimed is:

1. A method for interchanging components between a failing printing module and a functioning printing module, said method comprising the steps of:

providing a printing assembly (100) that includes a plurality of printing modules (M1-M4) that each include a specific toner color, wherein a first printing module (M2) is failing and at least one second printing module (M1) is functioning;

determining a toner use demand for the specific toners included in the plurality of printing modules (M1-M4); and swapping a location the first printing module (M2) with the location of the at least one second printing module (M1) and swapping the toner included in the first printing module (M2) with the toner included in the second printing module (M2) when the determining indicates that the first printing module (M2) has a toner use demand that is substantially greater than the toner use demand of the at least one second printing module (M1).

2. The method in accordance with claim 1 further comprising reassigning calibration data associated with the first printing module to the at least one second printing module.

3. The method in accordance with claim 1 further comprising determining the toner use demand of the first printing module and the at least one second printing module.

4. The method in accordance with claim 1 further comprising determining which components of the first printing module are failing.

5. The method in accordance with claim 4 further comprising swapping the failing component of the first printing module with the functioning component of the at least one second printing module, wherein the failing component is substantially identical to the functioning component.

6. A method of preventing downtime of a printer assembly, said method comprising:

providing a printer assembly that includes a plurality of printing modules that each include a first toner color coupled therein;

determining a toner use demand for each toner color of each printing module based upon a final printed image that the printing modules will be printing, wherein a primary printing module has the greatest toner use demand;

adding a redundant printing module that includes a redundant toner color that is substantially identical to the first toner color of the primary printing module; and printing the final image after the adding.

7. A method in accordance with claim 6 further comprising dividing the printing duties of the first toner color between the primary printing module and the redundant printing module.

8. A method in accordance with claim 7 further comprising dividing the printing duties of the first toner color and the redundant toner color equally between the primary print module and the redundant printing module.

9. A method in accordance with claim 6 further comprising repeating a toner color specific calibration associated with the primary printing module with the redundant printing module.

* * * * *